United States Patent [19]

Bolle et al.

[11] Patent Number: 4,614,108

[45] Date of Patent: Sep. 30, 1986

[54] DIE CART

[75] Inventors: Fred Bolle, Milford; John R. Herronen, Linden; Joseph M. Wright, Fenton, all of Mich.

[73] Assignee: Tek-Matik, Inc., Hartland, Mich.

[21] Appl. No.: 722,655

[22] Filed: Apr. 12, 1985

[51] Int. Cl.[4] ..... B21J 13/00

[52] U.S. Cl. ..... 72/446; 72/448

[58] Field of Search ..... 72/446, 448, 481

[56] References Cited

U.S. PATENT DOCUMENTS 3,831,427 8/1974 Lee ..... 72/448

4,408,521 10/1983 Schelli et al. ..... 72/448

FOREIGN PATENT DOCUMENTS 50930 4/1980 Japan ..... 72/446

193245 11/1982 Japan ..... 72/446

*Primary Examiner*—W. D. Bray

*Attorney, Agent, or Firm*—Krass & Young

[57] ABSTRACT

A die cart comprising a carriage adapted to be moved along track means toward and away from a press; a turntable mounted for rotary movement on the carriage and having a first load surface at one end thereof and a second load surface of the opposite end thereof; and a transfer device mounted on the turntable for fore and aft movement over the first and second load surfaces and having coupling means for engaging a die to push or pull a die positioned on either load surface onto or off of the bed of the press. The cart includes a first hydraulic motor carried by the carriage for moving the carriage along the track means; a second hydraulic motor carried by the turntable for rotating the turntable on the carriage; and a third hydraulic motor carried by the turntable for moving the transfer device fore and aft over the first and second load surfaces. The cart further includes a hydraulic pump; an air motor arranged to drive the hydraulic pump to create a source of pressurized hydraulic fluid; hydraulic valve means for selectively routing the pressurized hydraulic fluid to the first, second and third hydraulic motors; and air control means for selectively actuating the hydraulic valve means.

15 Claims, 9 Drawing Figures

DIE CART

BACKGROUND OF THE INVENTION

This invention relates to die transfer devices and, more particularly, to a die cart for use in changing dies in a press.

Presses represent very substantial capital investments and, accordingly, must be capable of accepting a plurality of different dies to perform a plurality of different operations. It is imperative, therefore, from a cost-effectiveness standpoint, that a provision be made to rapidly and efficiently change the die in the press so that the press may quickly be converted to a new and different function. A myriad of devices have been proposed to effect rapid and efficient transfer of dies in a press. Perhaps the most commercially feasible of these die transfer devices have involved some manner of cart which is wheeled to and from the press to selectively deliver and remove old and new dies from the press. Even these prior art die carts, however, have required the press to be down for a significant period of time in order to effect the required die change and, especially in situations where frequent die changes are required, the cumulative press down time is still excessive and very costly. Further, these prior art die carts have typically had limited onboard power capabilities and have, of necessity, had to rely on rollers both on the die cart and in the die press to enable the power mechanisms on the cart to move the dies into and out of position in the press.

SUMMARY OF THE INVENTION

This invention is directed to the provision of a die cart which allows rapid and efficient changing of the dies in a press.

This invention is further directed to the provision of a die cart that eliminates the need for costly and maintenance prone rollers in the die press.

The die cart according to the invention comprises a carriage adapted to be moved along track means toward and away from the press; a turntable mounted for rotary movement on the carriage and having a first load surface at one end thereof and a second load surface at the opposite end thereof; and a transfer device mounted on the turntable for fore and aft movement over the first and second load surfaces and having coupling means for engaging a die to push or pull a die positioned on either load surface onto or off of the bed of the press. With this arrangement, and according to the methodology of the invention, a new die may be positioned on the load surface of the turntable remote from the press; the carriage may thereafter be moved along the track means to a position in juxtaposition to the press; the transfer device may be coupled to the old die in the press and acuated to pull the old die out of the press and onto the near load surface on the turntable; the carriage may then be moved backwardly along the track means away from the press; the turntable may then be rotated through 180° to reverse the load surfaces and bring the new die into a position facing the press; the carriage may then be moved forwardly along the track means to again position the carriage adjacent the press; the transfer device may again be actuated to push the new die off of the turntable onto the press; the carriage may thereafter be moved backwardly along the track means away from the press; and the old die may thereafter be removed from the cart. The invention apparatus and methodology will thus be seen to minimize the down time for the press since this down time comprises only the relatively short amount of time required to pull the old die out of the press onto the cart, back the cart away from the press, rotate the turntable 180°, move the cart back up to the press, and push the previously delivered new die onto the press.

According to a further feature of the invention, the cart includes first motive power means carried by the carriage for moving the carriage along the track means toward and away from the press; second motive power means carried by the turntable for rotating the turntable on the carriage; and third motive power means carried by the turntable for moving the transfer device fore and aft over the first and second load surfaces.

According to a further feature of the invention, the first, second and third motive power means comprise a first hydraulic motor mounted on the carriage and second and third hydraulic motors mounted on the turntable.

According to a further feature of the invention, the cart further includes a hydraulic pump; an air motor arranged to drive the hydraulic pump to create a source of pressurized hydraulic fluid; hydraulic valve means for selectively routing the pressurized hydraulic fluid to the first, second and third hydraulic motors; and air control means for selectively actuating the hydraulic valve means. With this arrangement, the only power required to be delivered to the cart comprises pressurized air so that costly high pressure hydraulic lines to the cart are eliminated and costly and dangerous electric power supply to the cart is eliminated. This arrangement also provides an extremely high onboard force generating capability which enables sliding of the dies in and out of the press, thereby eliminating the need for rollers on the die and, more importantly, eliminating the need for costly and maintenance prone rollers in the press.

In the disclosed embodiment of the invention, the transfer device includes a bar assembly extending across the turntable and end structures at each end of the bar assembly repsectively mounted for fore and aft movement along opposite sides edges of the turntable, and the power means for the transfer device includes a drive screw treadably engaging a ball bearing screw carried by the end structures of the transfer device and a hydraulic motor mounted on the turntable and drivingly connected to the drive screw. This arrangement provides a simple and yet extremely powerful drive for the transfer device so that the device may push and/or pull even the heaviest of dies onto or off of the press bed.

DETAILED DESCRIPTION OF THE PREFERRED EMBODIMENT

Figure 1:
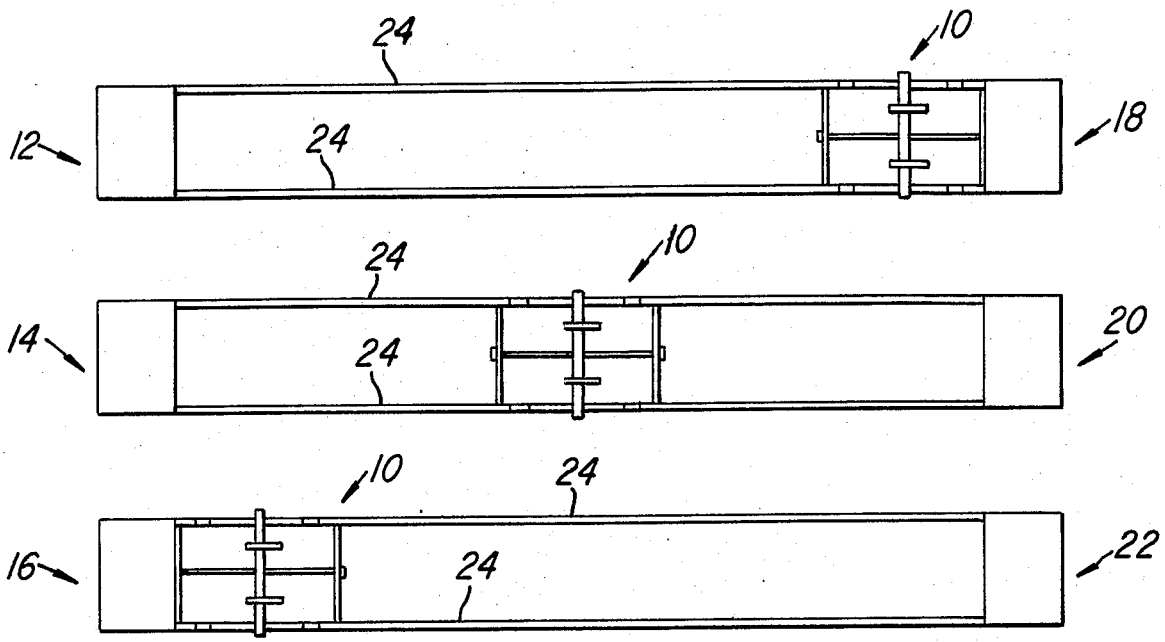
FIG. 1 is a schematic plan view showing die carts according to the invention in use between two lines of presses.

Die carts 10 according to the invention are seen in use in FIG. 1 in conjunction with a first line of presses 12, 14 and 16 and a second line of presses 18, 20 and 22. Die carts 10 are mounted on track means 24 so as to be movable selectively between the press lines to selectively change dies on either or both of the lines.

Figure 2:
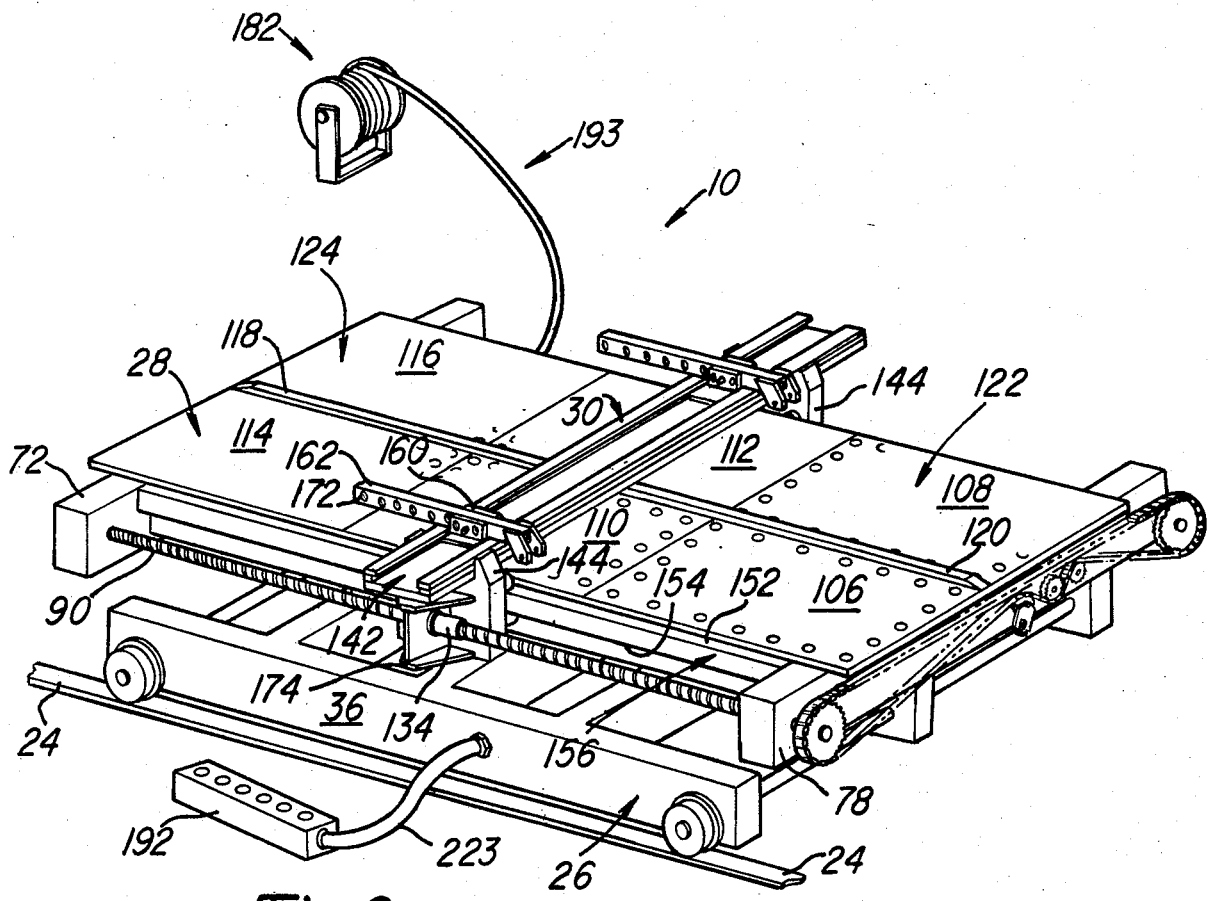
FIG. 2 is a perspective view of an invention die cart.

Each die cart, as best seen in FIG. 2, includes a carriage 26, a turntable 28 rotatably mounted on carriage 26, and a transfer device 30 mounted on turntable 28 for fore and aft movement over the upper surface of the turntable.

Figure 3:
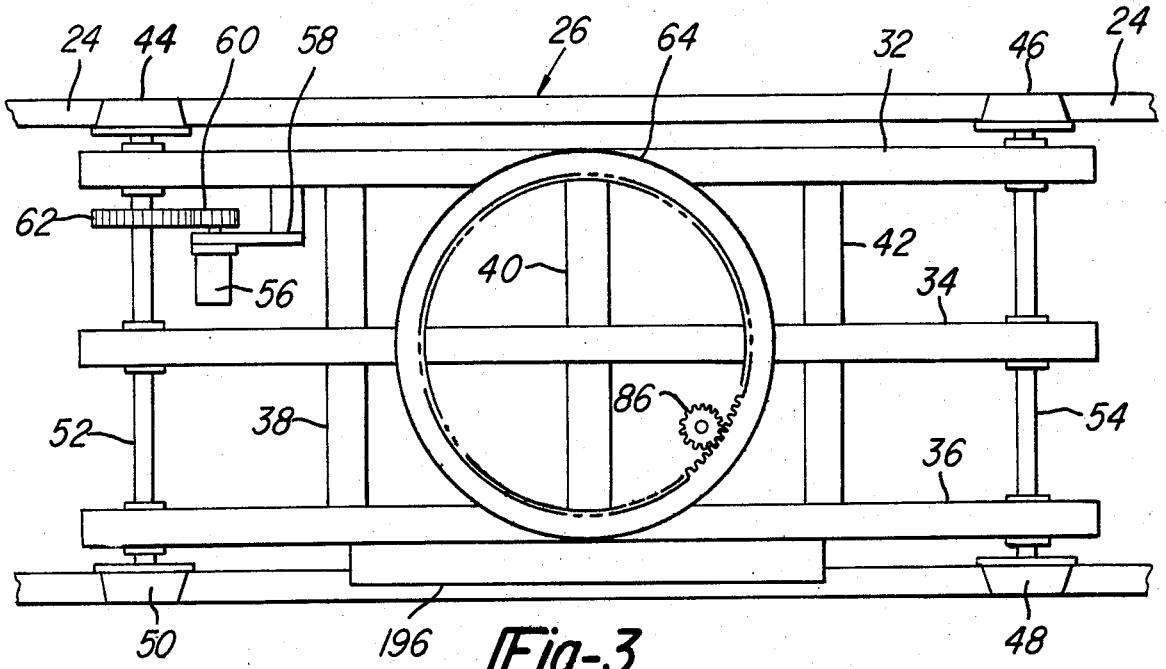
FIG. 3 is a plan view of the carriage of the invention die cart.

Carriage 26 (see also FIG. 3) includes a lattice frame having longitudinal members 32, 34 and 36 interconnected by transverse members 38, 40 and 42. Four wheels 44, 46, 48 and 50 are positioned at the four corners of the carriage with wheels 44 and 50 interconnected by an axle 52 and wheels 46 and 48 interconnected by an axle 54. A hydraulic motor 56 positioned on a bracket 58 secured to longitudinal frame member 32 includes an output pinion 60 meshingly engaging a spur gear 62 on axle 52 so that actuation of hydraulic motor 56 drives gear 62 to drive wheels 44 and 50 and drive carriage 26 along tracks 24. An internally geared ring gear 64 is positioned centrally on the upper side of the carriage frame. If desired, another hydraulic motor (not shown) may be similarly positioned to drive axle 54.

Figure 4:
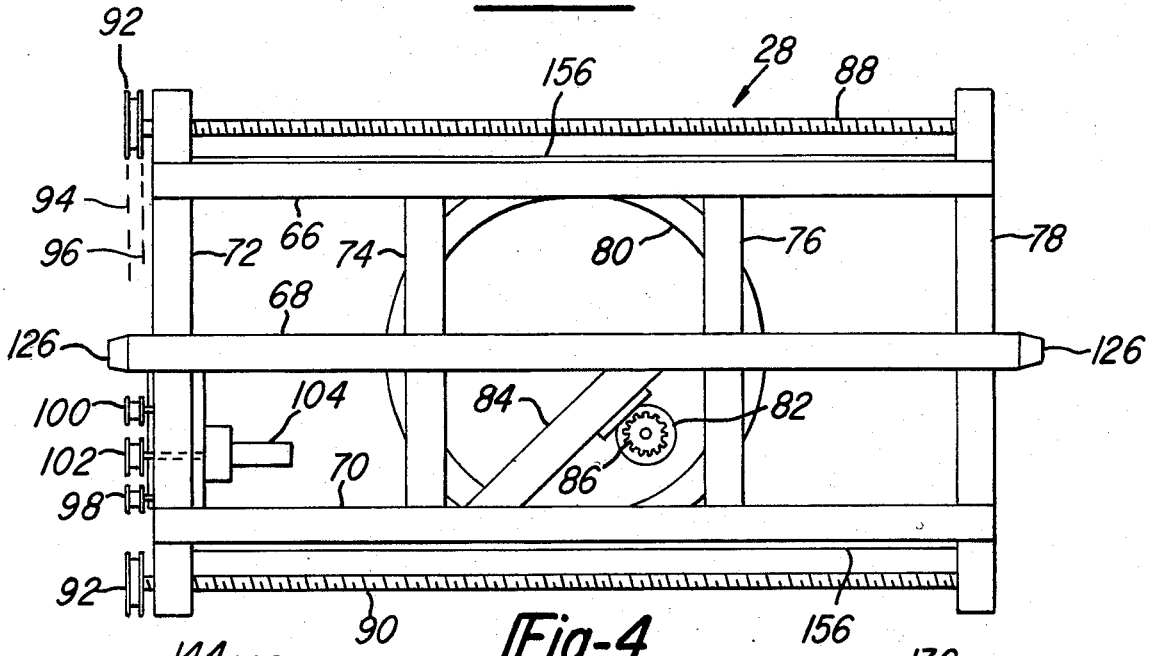
FIG. 4 is a plan view of the turntable of the invention die cart.

Turntable 28 (see also FIG. 4) includes a lattice frame including longitudinal frame members 66, 68 and 70 and transverse frame members 72, 74, 76 and 78. A ring member 80 is secured to the underside of the frame of the turntable and a hydraulic motor 82 is vertically positioned on an angled auxiliary frame member 84 with its pinion output shaft 86 positioned below the frame of the turntable for meshing engagement with the internal gearing of ring 64 of carriage 26. In the asssembled relation of turntable 28 and carriage 26, turntable ring 80 encircles ring gear 64 on the carriage with suitable bearing means interposed therebetween, and pinion drive gear 86 meshingly engages with the internal gearing of ring 64 so that actuation of hydraulic motor 82 walks pinion 86 around the internal periphery of ring gear 64 to rotate turntable 28 on carriage 26 about the center line of ring gear 64 and ring 80. Turntable 28 further includes elongated screw shafts 88 and 90 extending along the opposite side edges of the frame of the turntable and journaled at their opposite ends in the outboard portions of frame members 72 and 78. A double sprocket 92 is secured to one end of each of screw shafts 88 and 90 and a pair of chains 94 and 96 are trained around double sprockets 92, a double idler sprocket 98, a double adjustable idler sprocket 100, and a double drive sprocket 102. Drive sprocket 102 is driven by a hydraulic motor 104 mounted on transverse frame member 72 between longitudinal frame members 68 and 70. Actuation of hydraulic motor 104 drives double sprocket 102 to in turn drive double sprockets 92 and in turn drive screw shafts 88 and 90. A plurality of heavy guage metal plates 106, 108, 110, 112, 114 and 116 are boltingly secured to the upper surface of the turntable frame and a pair of central bars 118, 120 are also secured to the turntable frame and extend between the plates. Plates 106–116 define a first load surface 122 adjacent one end of the die cart and a second load surface 124 adjacent the other end of the die cart. Turntable 28 further includes a coupling member 126 at each end of the die cart for coaction with a similar coupler member on the press.

Figure 5:
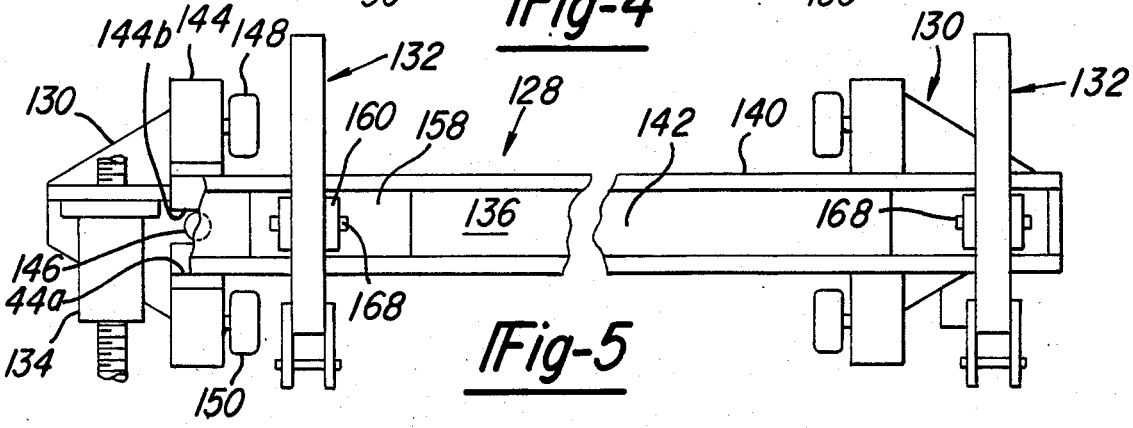
FIGS. 5, 6 and 7 are plan, elevational and end views respectively of the transfer mechanism of the invention die cart.
Figure 6:
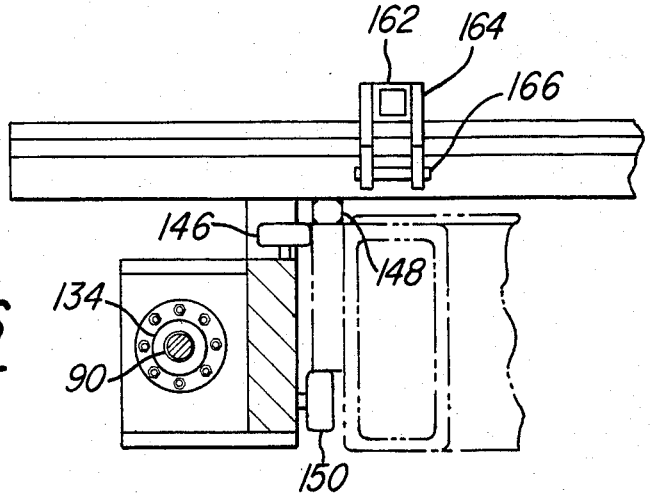
Figure 7:
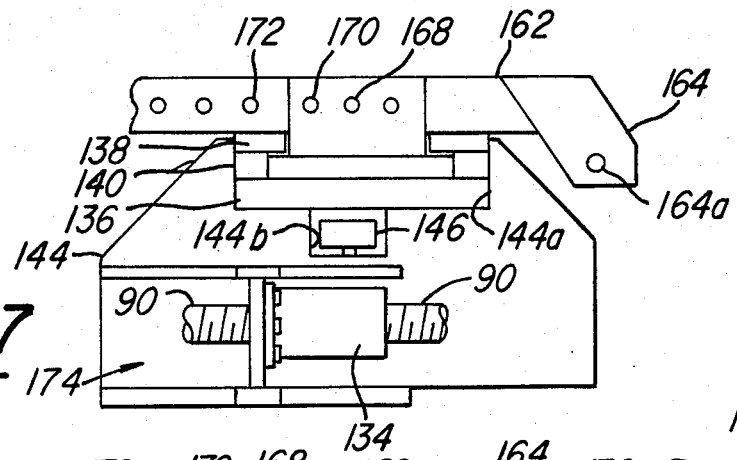

Transfer device 30 (see also FIGS. 5, 6 and 7) includes a bar assembly 128, end structures 130, coupling means 132, and ball bearing screws 134.

Bar assembly 128 is a composite structure including a base plate 136, a pair of upper plates 138, and a pair of spacer plates 140 which are boltingly secured together to form a channel 142.

End structures 130 include heavy duty vertically disposed plates 144 having a central cutout **144*a* for receipt of bar assembly 128 and a further central cutout 144*b* in which a guide roller 146 is mounted for rotation about a vertical axis. Two upper rollers 148 and two lower rollers 150 are journaled on the inner face of plate 144 for respective guiding and rolling coaction with upper guide surfaces 152 and lower guide surfaces 154 defined along the opposite side edges of the turntable 28 by guide plates 156 secured to the outboard faces of turntable side rails 66 and 70** respectively.

Each coupling means 132 comprises a plate 158 slideably received in channel 142, a pair of spaced brackets 160 rigidly upstanding from plate 158, a tubular arm 162 of rectangular cross section positioned between brackets 160, and a pair of plates 164 secured to one end of arm 62 and depending downwardly therefrom to define aligned apertures **64*a* receiving a removable coupling pin 166. Each coupling means 132 may be adjusted laterally along bar assembly 30 by sliding movement of plate 158 in channel 142 and each coupling means 132 may be adjusted longitudinally with respect to the bar assembly by selective positioning of a coupling pin 168 in any one of a plurality of holes 170 provided in brackets 160 and holes 172 provided along the length of arm 162**.

Ball bearing screws 134 are secured outboard of plate members 144 by a bracket structure 174 secured to the outboard face of plate 144. Each ball bearing screw 134 threadably receives a screw member 88, 90 so that suitable actuation of hydraulic motor 104 serves to move transfer device 30 fore and aft along the upper surface of turntable 28 with rollers 148 guiding along guide surfaces 152, rollers 150 guiding along guide surfaces 154, rollers 146 guiding along the outer faces of plates 156, and a central notch **136*a* in base plate 136 of bar assembly 128 guiding along central bars 118 and 120. The various guide surfaces are dimensioned such that the under face of base plate 136 minimally clears the upper surface of turntable plates 106–116**.

Figure 8:
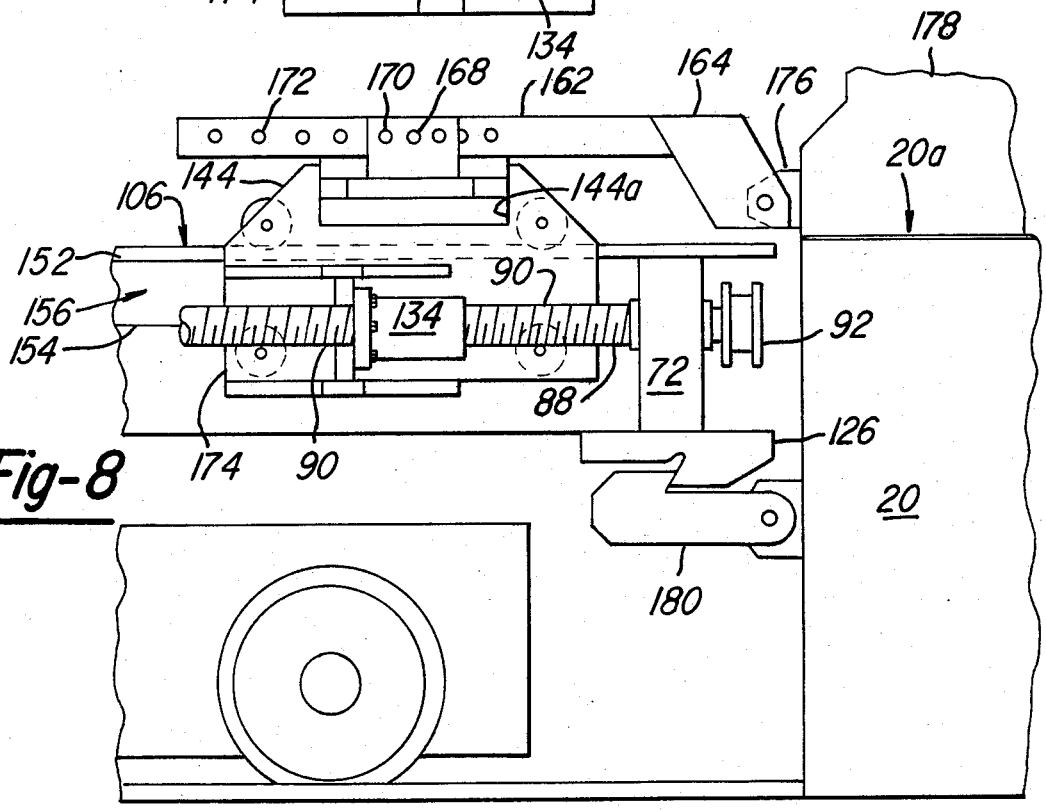
FIG. 8 is a fragmentary view showing the coaction between the invention die cart and a press being serviced by the die cart.

In use, if it is desired to change a die in press 20 for example, an overhead crain is used to deliver the new die to the cart 10 associated with that press with the new die being deposited on the load surface 124 remote from press 20. Motor 56 is now actuated in a direction to move the die cart to a position in juxtaposition to the press, as seen in FIG. 8, whereafter motor 104 is actuated in a direction to move transfer device 30 to a position in which coupling plates 164 on coupling arms 162 embrace suitable coupling devices 176 on the old die 178 positioned on the bed **20*a* of press 20, whereafter coupling pins 166 are passed through aligned apertures in plates 164 and coupling devices 176. Motor 104 is now actuated in a direction to withdraw transfer mechanism 30 from press 20 so that transfer mechanism 30 pulls the old die 178 off of the bed of press 20 and onto the near load surface 122 of the turntable 28. During this pulling movement of the old die off of the bed of the press, the die cart is precluded from movement relative to the press by the engagement of a spring biased latch member 180 carried by press 20 with the latch member 126 positioned on the forward underside of turntable 28 beneath load surface 122. After the old die has been pulled onto load surface 122, latches 126 and 178 are suitable disengaged, either manually or automatically, and carriage motor 56 is acutated in a direction to withdraw the die cart from the press to a position clear of the press. Turntable motor 82 is now actuated to rotate turntable 28 on the carriage 26 so that the new die positioned on load surface 124 is brought into a position adjacent the press and the old die positioned on load surface 122 is brought into a position remote from the press. Coupling arms 162 are now disengaged from the old die by removal of pins 166 and the arms are turned through 180° with respect to bar assembly 128 to bring coupling plates 164 into juxtaposition with a suitable coupling member 176 on the new die. Coupling arms 162 are then coupled to the new die by insertion of coupling pins 166 whereafter die cart motor 56 is actuated in a direction to again move the die cart to a position of juxtaposition to press 20 in which the latch member 126 associated with load surface 124 coacts with latch 180 to preclude relative movement between the die cart and the press. Transfer mechanism motor 104 is now actuated in a direction to advance the transfer mechanism toward the press so that the transfer mechanism pushes the new die off of load surface 124 and onto the bed 20***a* of the press. Once the new die has been positioned on the press, coupling pins 166 are withdrawn, transfer mechanism 30 is withdrawn to a central position on the turntable, the die cart is returned to a position removed from the press, and the overhead crain is utilized to remove the old die from load surface 122. The die cart is now ready for a new die change cycle. Obviously, the die cart is capable of performing the same rapid die change with respect to press 14 on the other press line and the die carts 10 associated with presses 12 and 18 and 16 and 22, respectively, function in a similar manner to achieve rapid die change with respect to their associated presses. The amount of time required to effect a particular die change is minimized since the new die is already present on one of the load surfaces of the die cart when the old die is pulled off of the press onto the other load surface so that the down time of the press is only that time required to remove the old die, back up the cart, spin the turntable, advance the die cart, and push the new die onto the bed of the press.

Figure 9:
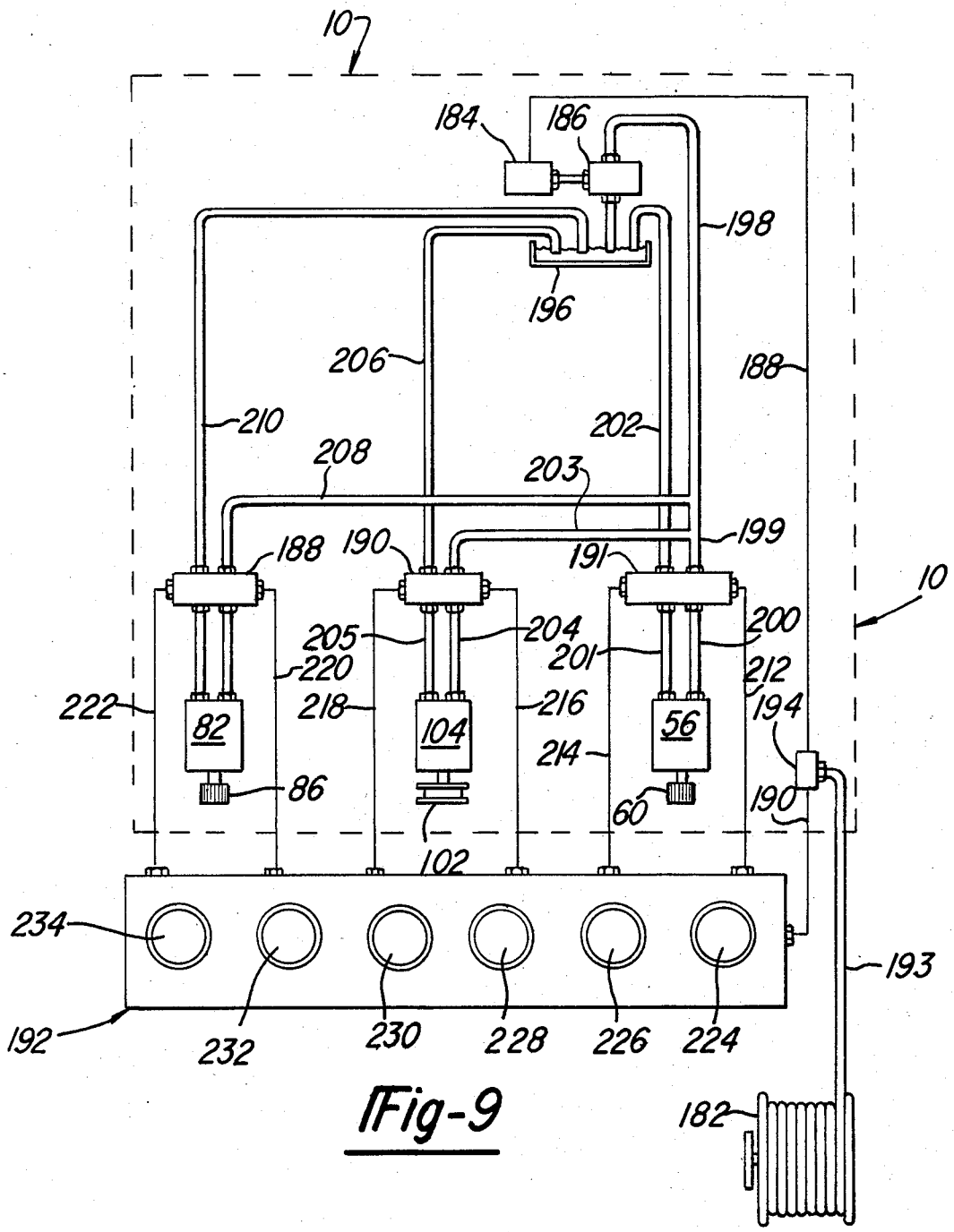
FIG. 9 is a schematic view of a control system for the invention die cart.

The control system seen schematically in FIG. 9 is designed to selectively deliver pressurized hydraulic fluid to hydraulic motors 82, 104 and 56 to selectively actuate each of the motors in both directions. The control system includes a hose reel 182, an air motor 184 mounted on die cart 10, a hydraulic pump 186 mounted on the die cart and driven by air motor 184, three position 4-way hydraulic control valves 188, 190 and 191 mounted on the die cart, and a pendant air control 192.

A hose 193 wound on reel 182 connects with a valve 194 mounted on die cart 10. An air line 195 extends from valve 194 to air motor 184 and another air line 196 extends from valve 194 to pendant control 192. Hydraulic pump 186 communicates at its inlet with a reservoir 197 and communicates at its outlet with a high pressure hydraulic output line 198. A hydraulic line 199 connects with line 198 and extends to one port of valve 191, hydraulic lines 200 and 201 connect further ports at valve 191 with the port of motor 56, and a hydraulic line 202 extends from a further point of valve 191 to reservoir 196. A further hydraulic line 203 connects with line 198 and extends to one port of valve 190, hydraulic lines 204 and 205 connect further ports of valve 190 with the ports of motor 104, and a hydraulic line 206 extends from a further port of valve 190 to reservoir 196. A further hydraulic line 207 connects with line 198 and extends to one port of valve 188, hydraulic lines 208 and 209 connect further ports of valve 188 with the ports of motor 82, and a further hydraulic line 210 extends from a further port of valve 188 to reservoir 196.

Air lines 212 and 214 extend from pendant 192 to opposite air ports of hydraulic valve 191; air lines 216 and 218 extend from pendant 194 to opposite air ports of valve 190; and air lines 220 and 222 extend from pendant control 192 to opposite air ports of valve 188. Air lines 190, 212, 214, 216, 218, 220 and 222 are bundled into an umbilical cord 223 connecting pendant 192 to die cart 10.

Pendant control 192 includes a plurality of push button operators 224–234 which function in known manner when depressed by an operator of the die cart to selectively route pressurized air through a respective air line 212–222. Specifically, operator 224 when depressed routes pressurized air through air line 212 to move valve 191 in which hydraulic fluid is routed to a motor 56 to drive the motor in a first direction; operator 226 when depressed routes pressurized air through air line 214 to move valve 191 to a position in route to which to route hydraulic fluid is routed to motor 56 to drive motor 56 in the opposite direction; operator 228 when depressed routes pressurized air through air line 216 to valve 190 to move valve 190 to a position in which in hydraulic fluid is routed to motor 104 to drive the motor in a first direction; operator 230 when depressed routes pressurized air through air line 218 to valve 190 to move valve 190 route to a position in which hydraulic to route fluid is routed to motor 104 to drive the motor in the opposite direction; operator 232 when depressed routes pressurized air through air line 220 to valve 180 to move valve 180 to a position in which hydraulic fluid is routed to motor 82 to drive the motor in a first direction; and operator 234 when depressed routes pressurized air through air line 222 to valve 188 to move valve 188 to a position in which hydraulic fluid is routed to motor 82 to drive the motor in the opposite direction. The operator of the die cart is thus able to control, through the single pendant control 194, fore and aft movement of carriage 26 through selective actuation of motor 56; rotary movement of turntable 28 through selective actuation of motor 82; and fore and aft movement of transfer mechanism 30 through selective actuation of motor 104.

Various check valves, shut off valves, relief valves and filters (not shown) will be employed in the control system where required to ensure that air motor 184 functions in coaction with hydraulic pump 186 to maintain an adequate onboard supply of pressurized hydraulic fluid and to ensure that the fluid is maintained in a relatively clean state.

Since the pressurized hydraulic fluid required to drive the several hydraulic motors is provided by an onboard air motor driving an onboard hydraulic pump, and since the hydraulic valves for routing the pressurized hydraulic fluids to the various hydraulic motors are controlled by air control valves, the only power required to be delivered to the cart comprises pressurized air as opposed to electrical power and/or hydraulic power. Air hoses, in contrast to hydraulic hoses, are relatively inexpensive and easily reelable and extendable. As compared to heavy duty electrical cables extending to the cart, the air hoses are relatively inexpensive and relatively safe since there is no safety hazard created by the potential slicing of the air hoses. Sealing of the air hoses is also much easier than sealing of high pressure hydraulic lines and a minimum of safety shielding is required as compared to high voltage electrical lines feeding into the die cart. Further, the described power arrangement provides an extremely high onboard force generating capability as compared to prior art devices and this high onboard force generating capability allows the dies to be slid into and out of the press with the consequent elimination of rollers on the die cart and, more importantly, the elimination of costly and maintenance prone rollers in the press.

The invention will thus be seen to provide a simple and effective apparatus and method for achieving rapid die changes in a press and will be further be seen to provide a die cart that eliminates the need for costly rollers on the die cart and in the press.

Although a preferred embodiment of the invention has been illustrated and described in detail, it will be apparent that various changes may be made in the disclosed embodiment without departing from the scope or spirit of the invention.

We claim:

1. A die cart comprising:

A. a carriage adapted to be moved along track means toward and away from a die press;

B. a turntable mounted for rotary movement on said carriage and having a first smooth flat upper load surface at one end thereof at the approximate height of the bed of the press and a second smooth flat upper load surface at the opposite end thereof at the same height; and C. a transfer device mounted on said turntable for fore and aft movement over said first and second load surfaces and having coupling means for engaging a die to push or pull a die positioned on either load surface onto or off of the bed of the press.

2. A die cart according to claim 1 and further including:

D. first motive power means carried by said carriage for moving said carriage along the track means toward and away from the press;

E. second motive power means carried by said turntable for rotating said turntable on said carriage through 180°; and F. third motive power means carried by said turntable for moving said transfer device fore and aft over said first and second load surfaces.

3. A die cart according to claim 2 wherein:

G. said first, second and third motive power means comprise separate hydraulic motors mounted respectively on said carriage, said turntable, and said turntable.

4. A die cart according to claim 3 wherein said cart further includes:

H. a hydraulic pump;

I. an air motor arranged to drive said hydraulic pump to create an onboard source of pressurized hydraulic fluid;

J. hydraulic valve means for selectively routing said pressurized hydraulic fluid to said first, second and third hydraulic motors; and K. air control means selectively actuating said hydraulic valve means whereby the only power required to be delivered to said cart comprises pressurized air.

5. A die cart acording to claim 2 wherein:

G. said carriage includes a plurality of wheels adapted to drivingly engage the track means and interconnected by at least one axle; and H. said first motive power means includes a hydraulic motor carried by said carriage and including a pinion output gear drivingly engaging a gear secured to said axle.

6. A die cart according to claim 2 wherein:

G. said carriage includes a ring gear fixed to said carriage and having internal gearing; and H. said second motive power means comprises a hydraulic motor carried by said turntable and including a pinion output gear drivingly engaging the internal gearing of said ring gear to rotate said turntable on said carriage.

7. A die cart according to claim 2 wherein:

G. said transfer device includes 1. a bar assembly extending transversely across said turntable,
2. end structures at each end of said bar assembly respectively mounted for fore and aft movement along opposite side edges of said turntable, and
3. a ball bearing screw secured to at least one of said end structures; and H. said third motive power means comprises 1. a drive screw threadably engaging said ball bearing screw, and
2. a hydraulic motor mounted on said turntable and drivingly connected to said drive screw.

8. A die cart according to claim 1 wherein:

D. said turntable is generally rectangular and includes opposite parallel side edges and opposite parallel end edges;

E. said first and second load surfaces are defined between said side edges at the respective opposite ends of the turntable; and F. said transfer device includes 1. a bar assembly extending transversely across the top of said turntable,
2. end structures on each end of said bar assembly respectively mounted for fore and aft movement along said side edges between opposite ends of the turntable, and
3. coupling means are carried by said bar assembly and including means for releasably engaging a die to push or pull the die along the first or second load surfaces.

9. A die cart according to claim 8 wherein:

H. said coupling means includes at least one arm carried by and extending transversely to said bar assembly and a coupling device at one end of said arm for releasable coaction with a compatible coupling device on the die to be engaged.

10. A die cart according to claim 9 wherein:

I. said bar assembly defines an upwardly opening transversely extending channel; and J. said coupling means includes a plate slideably mounted in said channel and secured to said arm, whereby to transversely adjust the position of said arm relative to said bar assembly and relative to said turntable.

11. A die cart comprising:

A. a carriage adapted to be moved along track means toward and away from a die press;

B. a turntable mounted for rotary movement on said carriage and having a first smooth flat upper load surface on the end thereof near the press at a height approximating the height of the bed of the press and a second smooth flat upper load surface on the end thereof remote from the press at the approximate height of the press bed, whereby, with said cart empty and positioned on the track means away from the press, a new die may be positioned on said second load surface;

C. first motive power means carried by said cart for moving said carriage along the track means, whereby said cart, wtih the new die positioned on said second load surface, may be moved along the track means to a position in juxtaposition to the press;

D. a transfer device mounted on said turntable for fore and aft movement along said turntable over said load surfaces and including coupling means for engaging a die, whereby, with the die cart positioned in juxtaposition to the press, an old die in the press may be engaged by said transfer device;

E. second motive power means carried by said cart for moving said transfer device fore and aft on said turntable, whereby the old die engaged by said transfer device may be pulled by said transfer device out of the bed of the press onto said first load surface, whereafter said first motive power means may be actuated in the sense to move said carriage on the track means away from the press; and F. third motive power means carried by said cart for rotating said turntable on said carriage, whereby said turntable may be rotated 180° on said carriage to bring said second load surface with the new die positioned thereon to a position near the press, whereafter said first motive power means may be actuated to move said carriage along the track means to a position in juxtaposition to the press, whereafter said second motive power means may be actuated in a sense to cause said transfer device to push the new die off of said second load surface and onto the bed of the press, whereafter said transfer device may be withdrawn and the carriage moved along the track means away from the press, whereafter the old die may be removed from the first load surface, whereby the cart is ready for another die change cycle.

12. A method of changing the dies in a press comprising:

A. positioning a rotatable load surface in proximity to the press;

B. delivering a new die to a portion of said load surface remote from the press;

C. pulling the old die out of the press and onto another portion of said load surface adjacent the press;

D. rotating said load surface to move said new die into a position adjacent the press and move said old die to a position remote from the press; and E. pushing said new die into the press.

13. A method according to claim 12 and including the further step of:

F. following pushing of said new die into the press, removing said old die from said load surface.

14. A method according to claim 12 wherein:

F. said method is performed by a die cart including a carriage mounted for movement toward and away from the press, a turntable rotatably mounted on the carriage, and a transfer mechanism mounted for fore and aft movement over the turntable;

G. said new die is delivered to a remote load surface on said turntable with the cart positioned away from the press;

H. the cart is thereafter moved to a position in juxtaposition to the press;

I. the transfer member is thereafter actuated to pull the old die out of the press and onto a near load surface on said turntable;

J. the cart is thereafter moved away from the press;

K. the turntable is thereafter rotated to bring the new die into a position adjacent the press;

L. the cart is thereafter moved back to the press; and

M. the tranfer mechanism is thereafter actuated to push the new die into the press.

15. A die cart comprising:

A. a carriage adapted to be moved along track means toward and away from a press;

B. a transfer device mounted on said carriage and operative when actuated to push or pull a die onto or off of said cart and off of or onto the bed of the press;

C. a hydraulic motor, mounted on said cart, operative to drive said transfer device;

D. a hydraulic pump, mounted on said cart, operative to deliver pressurized hydraulic fluid to said motor;

E. an air motor, mounted on said cart, operative to drive said hydraulic pump; and F. an air supply line connected at one end to said air motor and at its other end to a source of pressurized air remote from said cart.

* * * * *